United States Patent [19]

Howard, Jr.

[11] 4,184,592

[45] Jan. 22, 1980

[54] SPARK PLUG RETAINER

[76] Inventor: Jerry B. Howard, Jr., P.O. Box 11235, Fort Lauderdale, Fla. 33339

[21] Appl. No.: 880,733

[22] Filed: Feb. 24, 1978

Related U.S. Application Data

[63] Continuation of Ser. No. 743,727, Nov. 22, 1976, abandoned.

[51] Int. Cl.[2] ..... B65D 85/20

[52] U.S. Cl. ..... 206/327; 206/443; 206/486; 211/60 R; 294/87.2

[58] Field of Search ..... 206/199, 327, 486, 490, 206/443; 294/87.2, 87.26; 81/13; 211/74, 13, 60 R

[56] References Cited

U.S. PATENT DOCUMENTS

| | | | |
|---|---|---|---|
| 1,429,669 | 9/1922 | Zimmerman | 81/13 |
| 1,782,429 | 11/1930 | Johnson | 206/486 X |
| 2,337,243 | 12/1943 | Hutaff, Jr. | 206/199 X |
| 3,276,574 | 10/1966 | Meyers | 206/327 |
| 3,285,410 | 11/1966 | Brunsing | 206/199 |
| 3,778,232 | 12/1973 | McMorrow, Jr. | 211/74 X |
| 3,905,772 | 9/1975 | Hartnett et al. | 23/253 R X |

FOREIGN PATENT DOCUMENTS

| | | | |
|---|---|---|---|
| 274101 | 3/1951 | Switzerland | 206/486 |
| 150141 | 9/1920 | United Kingdom | 206/327 |

*Primary Examiner*—Stephen Marcus
*Attorney, Agent, or Firm*—Dowell & Dowell

[57] ABSTRACT

A device for retaining and displaying a plurality of spark plugs having a multiplicity of offset openings therein in which spark plugs of varying sizes may be slidably received and frictionally retained in an orderly relationship.

2 Claims, 5 Drawing Figures

Fig. 1
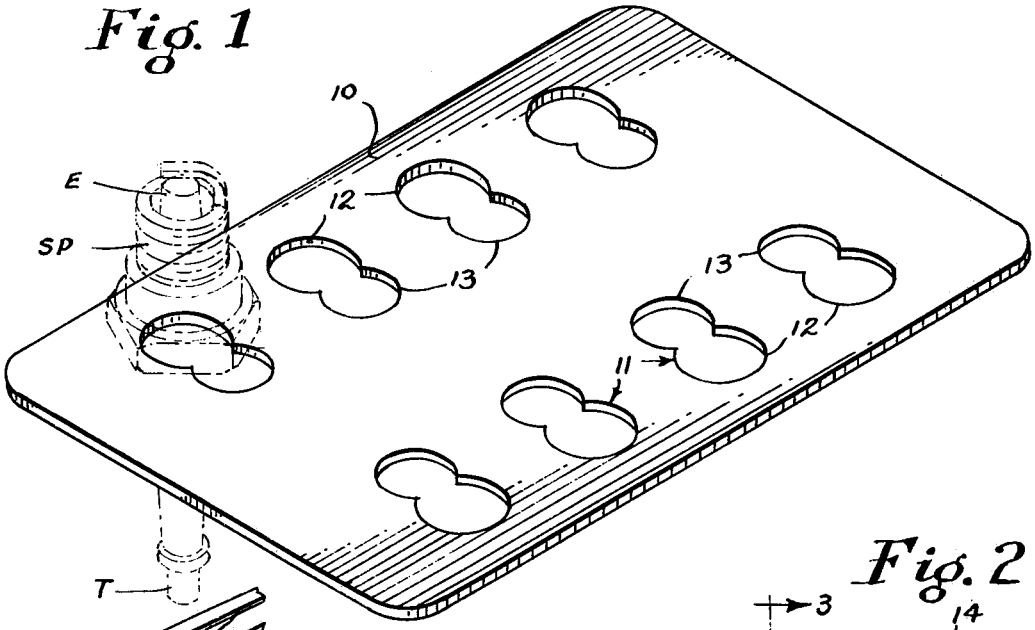
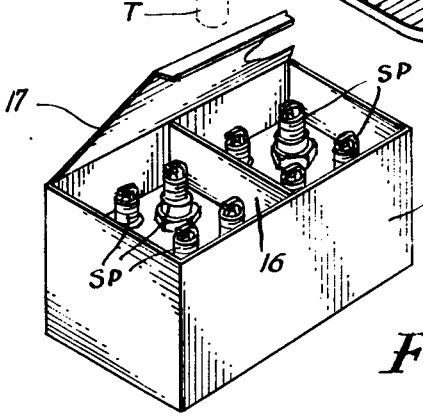
Fig. 5
Fig. 2
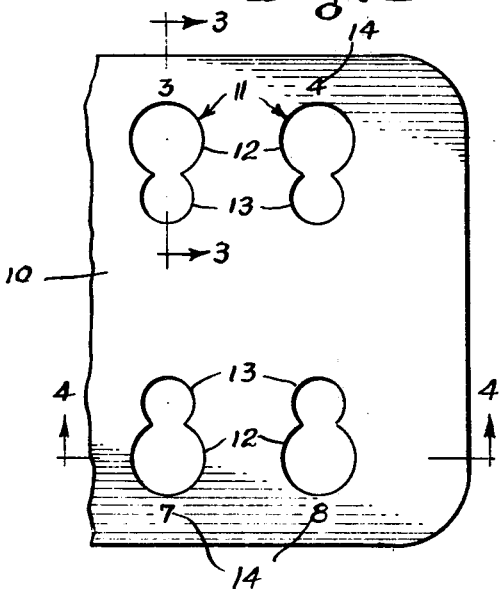
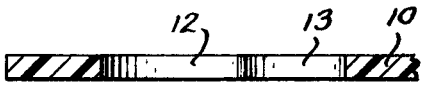
Fig. 3
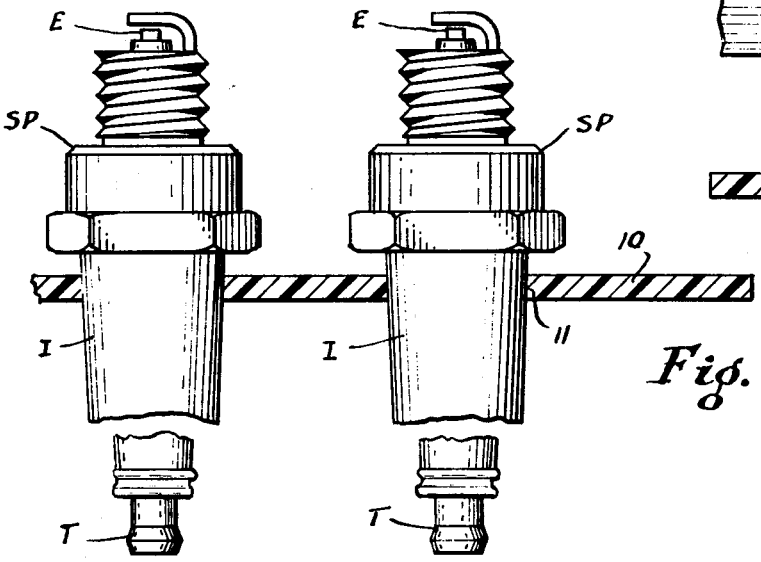
Fig. 4

SPARK PLUG RETAINER

This is a continuation of application Ser. No. 743,727, filed Nov. 22, 1976, now abandoned.

BACKGROUND OF THE INVENTION

1. Field of the Invention.

This invention is generally related to work-holder devices for spark plugs and particularly to a combination work-holder and packaging device in which a plurality of spark plugs of varying sizes may be frictionally received and supported in an orderly relationship having the electrode portion of each spark plug disposed outwardly from a supporting surface.

2. Description of the Prior Art.

Heretofore there have been many efforts directed to providing work-holder devices and packaging devices which are particularly adapted for retaining and/or displaying spark plugs. Due to the possibility of damage to the fragile electrode portion of spark plugs, it has long been a practice in the industry to provide packaging which affords the electrode some amount of protection from impact. In prior art packaging devices the electrode is protected against damage by the provision of specially designed supporting sleeves which are spaced from the bottom of the packaged container. U.S. Pat. No. 3,276,574 to Meyers and U.S. Pat. No. 3,554,369 to Paschke disclose two such packaging devices in which the spark plug is retained having its electrode portion supported by specially contoured openings in the container so that the electrode is spaced from the bottom of each of the respective packages.

In addition to the necessity of providing specially designed packages for the sale and distribution of spark plugs, it has also been recognized and much inventive effort has been directed to specially designed storage racks in which a plurality of spark plugs may be carried and/or stored for repair, emergency or other uses. As in the packaging art, the provision of storage racks for spark plugs has met with the same problem of providing a suitable retaining means which not only supports the individual spark plugs but does so in such a manner that damage to the electrode portion of the spark plug is prevented. In many such prior art storage rack devices, such as those disclosed in U.S. Pats. Nos. 1,404,958 to Hobbs and 1,391,471 to Gomez, the spark plugs are securely mounted by threaded engagement with specially designed socket portions of the racks so that their electrode portions are spaced from any surface against which a possible impact would cause damage to the electrode. However, such racks are often bulky and costly to construct and may require intricate spark plug retaining means such as the threaded support of the above mentioned prior art structures.

In addition to the packaging and storage devices discussed above, periodic maintenance which is required of most internal combustion engines necessitates the removal, inspection and maintenance of the engine's spark plugs. In this regard it is frequently the practice when performing maintenance on a piece of equipment to remove the plugs, place them carefully in a position on a supporting surface so that the electrodes will not be damaged and then inspect the plugs one by one, checking both the condition of the plug and also for a variety of telltale signs which the electrodes'condition may reflect about the possible problem areas in the cylinders from which the plugs were removed.

In this regard, the haphazard removal of spark plugs from the engine and their random placement on a working surface may often be counterproductive to the proper maintenance of the vehicle and the spark plugs themselves. Specifically the careful inspection of each of the electrode areas of the respective spark plugs will often indicate the malfunctioning of a particular cylinder. If the spark plugs have been randomly removed and placed on the working surface, there is no way to indicate to the mechanic which of the various cylinders may need special attention or maintenance. Further the random placement of a spark plug on any surface invites the possibility of damage to the electrode portion of the spark plug through an accidental impact of the electrode against a foreign object.

In addition to the proper indexing and retention of the spark plugs during their removal and maintenance, it is preferred that each spark plug be positively retained by a work-holder so that the cleaning and gapping of the spark plug can be performed with ease, accuracy and safety. Patents such as that to Zimmerman U.S. Pat. No. 1,429,669 disclose work-holders which are particularly adapted for holding various sizes of spark plugs. Such work-holders must often be clamped or supported on another surface and therefore their versatility is somewhat restricted. In addition, although each spark plug is supported by the work-holder during maintenance of an engine, there has been no provision for supporting all of the plugs in an indexed or orderly relationship which corresponds to the number of plugs and their placement within the respective cylinders of the internal combustion engine from which they were removed or into which they are to be placed.

Other examples of the prior art include U.S. Pat. No. 1,434,338 to Grose, U.S. Pat. No. 2,548,289 to Carraher, U.S. Pat. No. 3,285,410 to Brunsing, and U.S. Pat. No. 2,960,235 to Farber et al.

SUMMARY OF THE INVENTION

The present invention is embodied in a retainer for packaging and/or supporting a plurality of spark plugs in an orderly arrangement which may correspond to the respective positioning of the spark plugs in an internal combustion engine. The retainer is provided with a plurality of openings into which various sizes of spark plugs are frictionally received. Each opening is formed having at least two offset and yet partially overlapping generally circular apertures, thereby each opening may selectively receive various sizes of spark plugs.

It is the primary object of this invention to provide a retainer for spark plugs which can be used both as part of a shipping and handling package and as a work-holder for the maintenance and/or storage of spark plugs.

It is a further object of this invention to provide a work-holder for spark plugs which permits the spark plugs to be maintained in a corresponding and ordered relationship relative to the cylinders from or into which the spark plugs are removed or placed, respectively.

It is another object of this invention to provide an inexpensive work support for spark plugs which permits the spark plugs to be supported so as to reduce the likelihood of an accidental impact with a foreign object which may result in damage to the electrode portion of the plug.

BRIEF DESCRIPTION OF THE DRAWINGS

FIG. 1 is a perspective view illustrating the invention as it is used to support spark plugs.

FIG. 2 is a fragmentary top plan view thereof.

FIG. 3 is an enlarged section taken along line 3—3 of FIG. 2.

FIG. 4 is an enlarged section taken along line 4—4 of FIG. 2 illustrating the frictional engagement of the spark plugs with the retainer device.

FIG. 5 is a perspective view of the invention as it may be used with one form of packaging.

DESCRIPTION OF THE PREFERRED EMBODIMENT

With continued reference to the drawings, a spark plug retainer 10 is preferably constructed in a generally rectangular configuration and is either a molded thermoplastic material or is cut from a relatively flat sheet of rigid or semi-rigid thermoplastic material. Although thermoplastic material is believed to be the most versatile, durable and low-cost material from which the retainer may be formed, other materials, such as wood, metal and the more durable paper products such as heavy cardboard or the like may be used.

The design of the retainer 10 is necessarily simplistic in order that it may be durable enough for repeated use and yet economically feasible of being utilized in a plurality of applications which include not only the distribution, sales, and packaging of spark plugs, but also the maintenance and storage of the plugs by purchasers and maintenance personnel. In the regard it is one of the primary functions of the retainer to provide a support for a plurality of spark plugs SP in such a manner that the more fragile electrode portions E of the plugs are maintained in an elevated position being disposed outwardly from any horizontal supporting surface, as shown in FIGS. 1, 4 and 5.

In order to secure a plurality of spark plugs SP to the retainer 10, a multiplicity of offset openings 11 are provided therethrough. As shown in FIG. 1, eight such offset openings are provided through the spark plug retainer 10, such openings being disposed in spaced generally parallel lines along either side of the retainer. Although the number of openings through the retainer may vary depending upon the number of spark plugs to be packaged or sold or the contemplated use of the retainer after sale, it will be noted that the embodiment shown in FIG. 1 is specifically designed for an eight cylinder internal combustion engine.

Each opening 11 includes a pair of generally circular apertures 12 and 13 which are arranged in an overlapping configuration so that a portion of each aperture 12 is contained or disposed within the circumference of aperture 13 and vice versa. The overall arrangement of the apertures 12 and 13 actually form an opening having a shape somewhat resembling a figure eight. In order to permit the retainer to be used as a work-holder for a variety of differently sized spark plugs, the apertures 13 are of a lesser radial dimension than the apertures 12. Further, the apertures 12 are of sufficient size to frictionally engage the insulated portion I of one size of spark plug, as shown in FIG. 4, while the somewhat smaller apertures 13 are designed to frictionally engage spark plugs having an insulated portion which is of a somewhat smaller diameter. By placing the apertures in an overlapping relationship and thereby providing two passages through the retainer which are in open communication, the amount of area necessary to provide an adequate working or supporting surface is effectively reduced. Further, although only two generally circular offset apertures 12 and 13 are shown in the preferred embodiment, it is contemplated that other offset apertures could be provided in open communication with apertures 12 and 13 to thereby increase the versatility of the device to support even a greater variety of spark plug sizes.

As an example, the dimensions of a typical retainer 10 may be approximately $5'' \times 3\frac{1}{4}'' \times \frac{1}{8}''$. The openings 11 are placed on approximately 1" centers. The apertures 12 and 13 are approximately $\frac{1}{2}'$ and $\frac{1}{2}'$ in diameter, respectively, with the distance between the centers of the apertures being approximately $\frac{3}{8}''$.

The specific arrangement of the openings in the retainer is such as to coincide with the relative arrangement of the cylinders of the internal combustion engine in which or from which the spark plugs are to be placed or removed, respectively, and to this end some appropriate marking or identification 14 may be stamped, embossed, printed, or otherwise provided adjacent each opening as shown in FIG. 2. In this manner when working or performing maintenance on an engine, an orderly removal of the spark plugs and the corresponding placement of the spark plugs within the retainer will accurately reflect the relative placement of the spark plugs within the engine. Therefore, as an inspection is made of each of the spark plugs after its removal, a person may easily note which cylinder may be presenting problems and require specific attention. Such indexing of the spark plugs with their respective cylinders saves valuable time and aids in the pinpointing of possible problem areas.

As previously discussed, an inherent problem in working on and handling spark plugs is the possibility of damage to the electrode E of the spark plug. Therefore, any package or work-holder should provide some means of insuring the electrode is maintained in such a position as to be free from being accidentally abutted against a surface or object and thereby being damaged. With the present invention, spark plugs are maintained in a generally vertical placement with their electrodes disposed away from a supporting surface by insertion of the spark plugs into the retaining apertures in the retaining plate 10 in such a manner that the tips T of the spark plugs are disposed downwardly and rest on a supporting surface, as shown in FIG. 4.

The placement and removal of spark plugs from the retainer are accomplished in a vertically downward movement and upward movement, respectively. The spark plugs are securely maintained within the apertures by frictional engagement of the insulating housing I of each spark plug with the generally circular wall of the apertures 12 or 13 of the openings 11. In this manner the electrode portion E of the spark plug is always maintained outwardly from a supporting surface. After a spark plug has been frictionally received within the apertures 12 or 13, it will be noted that the possibility of the electrode being damaged by accidentally being rolled against a surface is prevented by the generally elongated and planar structure of the retainer. This is true even when a single spark plug is maintained in a retainer such as is exemplified in FIG. 1.

In the use of the retainer as a packaging device, it is contemplated that a plurality of spark plugs may be inserted with a downward motion into frictional engagement with the appropriate apertures of the device at a packaging plant. Having been engaged and thereby being retained by the spark plug retainer 10 so that the electrode portions of the spark plugs are disposed generally upwardly, the retainer and spark plugs may be inserted into a conventional box-like structure having side walls 15 (FIG. 5), a top wall 17, and a bottom wall (not shown). Alternatively, a clear durable package could be formed in any desired manner as by heat shrinking techniques. In order to insure that damage to the electrodes by the accidental placement of the package in upsidedown position is prevented, one or more vertically disposed wall portions 16 are disposed along the upper surface of the retainer 10 and between at least some of the electrode portions of the package. Such wall portion extends outwardly from the retaining device a distance which is slightly greater than that of the electrodes, so that the electrodes E are spaced from the top wall 17. If the package is accidentally placed in the wrong position, such wall portion maintains the weight of the package and prevents damage to the electrodes. When it is desired to use the new spark plugs which are housed in the box 15, the retainer need only be lifted from the box and as each spark plug is successively removed from the internal combustion engine, the old plugs may be placed in the appropriate apertures vacated by the replacement plugs.

When it is desired to use the spark plug retainer as a work-holder, the spark plugs which are being removed from an internal combustion engine may be placed in a relationship in the retainer which corresponds with that of their placement within an internal combustion engine so that the properties of each cylinder may readily be determined by inspection of the respective spark plug. As each spark plug is removed from its cylinder, a person need only insert the tip of the spark plug down through the proper aperture 12 or 13 until the insulated portion of the spark plug is frictionally and securely engaged with the retainer. Thereafter if the retainer with the spark plug or plugs mounted therein is rested on a surface, the tips of the spark plugs and the retainer plate 10 will insure that the electrodes of the spark plugs are maintained vertically disposed away from the supporting surface and are further prevented from accidentally being rolled or dropped and thereby damaged.

I claim:

1. The combination of a package and a removable retainer plate for storing and supporting a plurality of spark plugs of a selected size in a manner to prevent damage thereto as well as to maintain the spark plugs in an orderly relationship when the retainer plate is removed from the package, each of the spark plugs including a tapered insulating portion having a terminal at one end and a base portion with an electrode at the opposite end, comprising package means including wall structure substantially surrounding at least the electrodes of a plurality of spark plugs, a retainer plate normally located within said package means and including a thin generally rectangular body of substantially rigid material having flat upper and lower surfaces, said retainer plate having a plurality of openings disposed in spaced generally parallel rows along the same, each of said openings of said retainer plate including a larger partially circular portion inter-connected to a smaller partially circular portion by a reduced waist, each of said partially circular portions extending substantially more than half the diameter of each portion, each of said partially circular portions including a peripheral wall extending entirely through said retainer plate, said wall of said larger partially circular portion being of a size to frictionally engage and retain the insulated portion of a spark plug of a first size adjacent to the base portion thereof, said wall of said smaller partially circular portion being of a size to frictionally engage and retain the insulated portion of a spark plug of a second size adjacent to the base portion thereof, each of said openings receiving only one spark plug at a time so that a series of spark plugs of a selected size are frictionally retained within selected partially circular portions with their electrodes located on the same side of said retaining plate, and a removable wall member engageable with said package wall structure and said retainer plate, said wall member being of a size to space said electrodes from said package wall structure to protect the spark plugs during storage, whereby said retainer plate supports a plurality of spark plugs within said package means during storage and may be removed from said package means after which said spark plugs may be removed one at a time from said retainer plate for use.

2. The structure of claim 1 in which said upper surface of said retainer plate has numbered indicia for each of said openings which corresponds to the cylinder number of an automobile engine.

* * * * *